United States Patent [19]

Nagata et al.

[11] Patent Number: 4,982,465

[45] Date of Patent: Jan. 8, 1991

[54] LEVEL-VARIABLE SUPPORTING APPARATUS

[75] Inventors: Nobuo Nagata, Yokohama; Yoshitsugu Hirokawa, Kamakura, both of Japan

[73] Assignee: Nippon Zeon Co., Ltd., Tokyo, Japan

[21] Appl. No.: 495,802

[22] Filed: Mar. 16, 1990

[30] Foreign Application Priority Data

Mar. 20, 1989 [JP] Japan ..... 1-69099
Mar. 27, 1989 [JP] Japan ..... 1-74182

[51] Int. Cl.[5] ..... A61G 7/04; A47C 27/10

[52] U.S. Cl. ..... 5/450; 5/447; 5/453; 5/456; 254/93 HP; 254/93 R

[58] Field of Search ..... 5/447, 450, 453, 455, 5/456; 254/93 R, 93 HP; 128/38, 53

[56] References Cited

U.S. PATENT DOCUMENTS

| | | | |
|---|---|---|---|
| 3,600,727 | 8/1971 | All | 5/455 X |
| 3,721,232 | 3/1973 | Trenchard | 5/456 X |
| 3,858,379 | 1/1975 | Graves et al. | 5/450 X |
| 4,079,915 | 3/1978 | Mountain | 254/93 HP |
| 4,281,425 | 8/1981 | Jacobs | 5/455 |
| 4,371,997 | 2/1983 | Matson | 5/455 X |
| 4,588,229 | 5/1986 | Jay | 5/450 X |
| 4,688,283 | 8/1987 | Jacobson et al. | 5/455 X |
| 4,924,634 | 7/1990 | Sulott et al. | 5/455 X |

FOREIGN PATENT DOCUMENTS

| | | | |
|---|---|---|---|
| 86/02244 | 4/1986 | World Int. Prop. O. | 5/453 |

*Primary Examiner*—Michael F. Trettel
*Attorney, Agent, or Firm*—Armstrong, Nikaido, Marmelstein, Kubovcik & Murray

[57] ABSTRACT

A level-variable supporting apparatus is provided, which is so constituted that: a reversible swelling and contractive substance, which, with a prescribed temperature defined as the boundary, absorbs a swelling solution and then swells at a range of temperature on one side and discharges the swelling solution and then contracts at a range of temperature on the other side, is contained in liquidtight container which is expandable and shrinkable in prescribed directions; a liquid guiding portion to supply the swelling solution to the container and discharge it from the container, and a heating means to heat the substance are provided; and the swelling and contraction of the substance due to the change in the temperature of the substance with the prescribed temperature as the boundary causes the container to expand and shrink in the prescribed directions, thus leading to the change of the supporting position of a supported object supported by the container.

21 Claims, 10 Drawing Sheets

P1
P2
P3
P4
P5
P6
P12

LEGEND
:STATE OF SWELLING
:STATE OF CONTRACTION
:LEVEL IN INITIAL STATE (a)
:HEATING ELEMENT ON

LEVEL-VARIABLE SUPPORTING APPARATUS

BACKGROUND OF THE INVENTION

1. Field of the Invention

This invention relates to a level-variable supporting apparatus.

2. Description of the Prior Art

When a sick person remains confined to his bed for a long time, decubitus will occur. Decubitus is a state in which ulcer is formed as follows: since the patient is laid prolongedly in bed with a substantially fixed posture, certain regions of his body continue to be pressed by the underlying bedclothes, causing the blood capillaries of the regions to be compressed: and this leads to the impairment of subcutaneous blood circulation and further to the necrosis of tissues, thus resulting in the development of ulcer. An internal pressure of blood capillaries is about 25 mmHg, and if an external pressure higher than this value is given for many hours, the above mentioned circulatory disorder readily occurs. Decubitus is also called bedsore, which gives a great pain to the sick person. Especially in a sick person who is prostrated and poorly nourished, decubitus develops within a short period of time.

Attempting to prevent the development of decubitus in such a manner that only certain regions of the body are not strongly pressed for many hours through contact with bedclothes, the following various proposals have been made to date.

It was proposed that by selectively feeding air to many air chambers, these air chambers are selectively inflated to change the pressed regions of the body (Japanese Patent Publication Open to Public Inspection No. 20173/1977; Japanese Patent Examined Publication No. 40296/1985). These methods involve the problems that the apparatus becomes large in size because an air compressor and many valves are required and that sleep is disturbed by sounds from the opening and closing of valves, the exhaust of air, and the operation of the air compressor.

Another proposal is a highly cushiony pad which is packed with polyurethane gel or polyvinyl gel (Japanese Patent Publication Open to Public Inspection No. 38118/1980 or No. 159847/1982). This pad is to evenly distribute the pressure that the body receives from the pad. Due to its highly cushiony property, the above pad makes a bed all the more uncomfortable to sleep in and, moreover, the development of decubitus cannot be completely prevented in the state of evenly distributed pressure.

Further to the above mentioned proposals, a bed was proposed in which, with shape memory alloy springs incorporated, these springs are selectively heated to change the distribution of pressure (Japanese Patent Publication Open to Public Inspection No. 129021/1984). It will, however, cause an increase in the production cost to use many shape memorial alloy springs in the above case.

Other than the above mentioned apparatuses for prevention of decubitus, there are those supporting apparatuses which support a supported object so as to be movable in upward and downward directions, such as a screw jack and a rack and pinion jack, which utilize screws, racks, and gears, and a hydraulic jack utilizing oil hydraulics or hydraulic pressure. These jacks are inappropriate depending upon the type of the supported object due to noise or vibration produced by the jacks themselves, or are untoward at a place requiring cleanliness because of environmental contamination caused by oil or water leakage. In addition, a screw jack or a rack and pinion jack needs a reduction gear to reduce the speed of its upward or downward movement. A supporting apparatus which has solved these problems may be a supporting apparatus which utilizes the return of the shape memory alloy to its original shape, but still addressing a problem that such a method allows the shape of the supporting portion to lack freedom. An attempt to create a supporting apparatus which overcomes the above mentioned problem will result in a complicated structure, causing the apparatus to be difficult to handle and costly as well. A desirable supporting apparatus, which is to be used in a clean environment and also to support a sick person or a supported object which is in danger of deteriorating its quality due to vibration, is an apparatus that has a simple structure, is easy to handle, can allow the supported object or sick person to gently move upward and downward without generating vibration or noise, and, moreover, does not contaminate the environment. At present, however, such an apparatus has not yet been developed.

OBJECT AND SUMMARY OF THE INVENTION

Accordingly, it is an object of the present invention to provide a supporting apparatus which has a simple structure, can operate quietly, can be manufactured at a low cost, and can expand and shrink in prescribed directions (for example, in upward and downward directions) to change the supporting position of a supported object; for example, a mat for prevention of decubitus which can prevent the occurrence of decubitus by changing with time the pressure that is received by the plural regions of the body of a sick person.

The present invention relates to a level-variable supporting apparatus, which is so constituted that: a reversible swelling and contractive substance, which, with a prescribed temperature defined as the boundary, absorbs a swelling solution and then swells at a range of temperatures on one side and discharges this swelling solution and then shrinks at a range of temperatures on the other side, is contained in a liquidtight container which is expandable and shrinkable in prescribed directions; a liquid guiding portion to supply the swelling solution to the above mentioned container and discharge it from the container, and a heating means to heat the above mentioned substance are provided; and the swelling and contraction of the substance due to the change in the temperature of the substance with the above prescribed temperature as the boundary causes the container to expand and shrink in the prescribed directions, thus leading to the change of the supporting position of a supported object which is supported by the container.

DESCRIPTION OF THE PREFERRED EMBODIMENTS

The embodiments of the present invention will be hereunder described.

[EXAMPLE 1]

This is an example in which the present invention was applied to a mat for prevention of decubitus.

Figure 1:
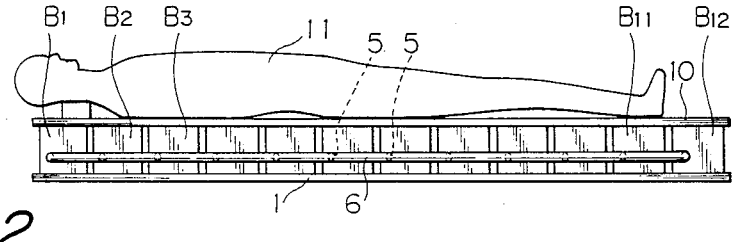
FIG. 1 is a schematic front view of a main portion showing a state in which a sick person is lying on a mat for prevention of decubitus.
Figure 2:
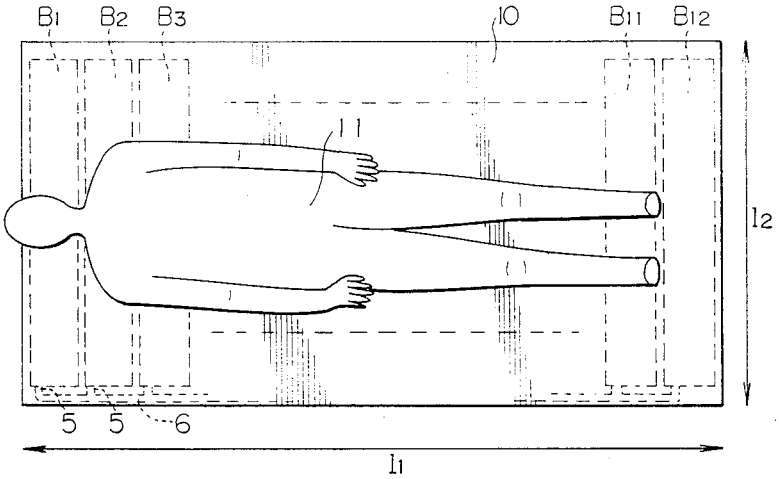
FIG. 2 is a schematic plan view of a main portion in the same state as in FIG. 1.

FIG. 1 and FIG. 2 show a state in which a sick person lies on a mat for prevention of decubitus (hereinafter called simply a "mat"); FIG. 1 is a schematic front view of a main portion, and FIG. 2 is likewise a plan view. With n pieces (12 pieces in this example) of bags $B_1$, $B_2$, $B_3$, . . . , $B_n$ ($B_{12}$ in this example) lined up on a common base plate 1, thin bedclothes (for example, a bed sheet) 10 is placed on the bags, and a sick person 11 then lies on said bedclothes 10. The bags $B_1$, $B_2$, $B_3$, . . . , $B_{12}$ are made of plain fabrics (in this example, warp: polyester, woof: spandex) which are expandable and shrinkable only in upward and downward directions.

Each bag contains a liquidtight rubber package and a plate-shape heating element 7 that is sandwiched between the above package and bag at the bottom. They will be explained later with reference to FIG. 4 to FIG. 6.

Bags $B_1$, $B_2$, $B_3$, . . . , $B_{12}$ are lined up in a row in the longitudinal direction of the base plate 1, each of them having a length close to a length $l_2$ of the base plate 1 in the direction of its width. The inside packages are so contrived as to communicate with each other by branch pipes 5 and a flexible communicating pipe 6 which is connected with each of the branch pipes 5 (see FIG. 3 and FIG. 4). The dimensions of the base plate 1 and the mat 10 may be properly determined depending on the size of a bed to be adopted. In this example, however, they are set at, for example, 2 m for the length $l_1$, and 90 cm for the width $l_2$.

Figure 3:
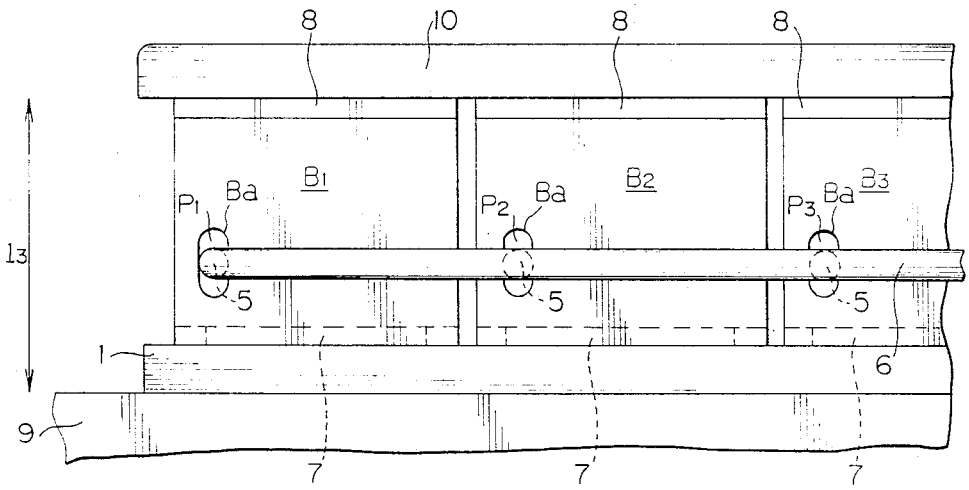
FIG. 3 is a partially enlarged view of FIG. 1.

FIG. 3 is a partial enlarged view of FIG. 1. The common base plate 1 is placed on a bed (or tatami) 9, and the bags $B_1$, $B_2$, $B_3$, . . . on the base plate 1 are provided with a through hole Ba through which the branch pipe 5 passes. The mat 10 is placed on the bags $B_1$, $B_2$, $B_3$, . . . , and the height $l_3$ of the supporting apparatus is set at about 3 to 20 cm including that of the base plate 1. The height $l_3$ may be selected as occasion demands in correspondence with the thickness of the mat 10.

Figure 4:
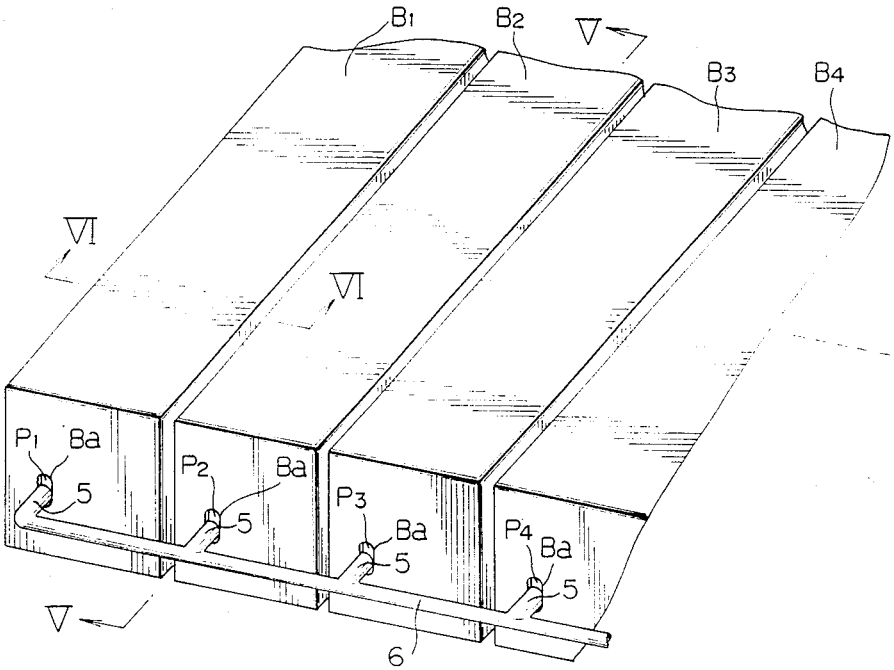
FIG. 4 is a perspective view showing the relationship between a plurality of packages and the pipes which connect these packages.

FIG. 4 is a diagonal view showing a state in which the respective packages $P_1$, $P_2$, $P_3$, . . . are communicating with each other through the branch pipes 5 and the pipe 6 which are connected with these pipes.

Figure 5:
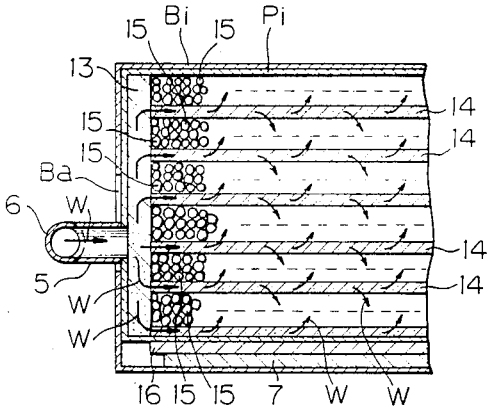
FIG. 5 is a sectional view along the line V—V of FIG. 4.
Figure 6:
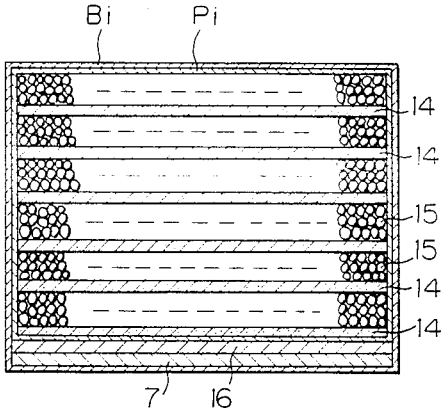
FIG. 6 is a sectional view along the line VI—VI of FIG. 4.

The structures of each bag and each package (hereinafter indicated by putting marks Bi and Pi, respectively, to each bag and each package) are as shown in FIG. 5 that is a diagonal sectional view along the line V—V of FIG. 4 and in FIG. 6 that is a diagonal sectional view along the line VI—VI of FIG. 5. The branch pipe 5 is connected with the side wall of a rubber package Pi, and is further connected with the communicating pipe 6 of FIG. 4. EPDM (ternary copolymer of ethylene, propyrene and diene monomers), CR (chloroprene rubber), and PUR (polyurethane rubber), which have weatherability and some heat durability, can be preferably used as the material of the package Pi. A first porous plate 13 is positioned inside the side wall of the package Pi with which the pipe 5 is connected, and second porous plates 14 are positioned horizontally at regular intervals in contact with the first porous plate 13, the spaces between the second porous plates 14 being packed with a reversible swelling and contractive substance, namely, beads 15. The porous plate 13 is preferably made of, for example, soft polyurethane foam with an open cell ratio of 30 Vol % or more so as to be able to follow the movement of the porous plates 14 in upward and downward directions. The porous plates 14 are made of, for example, Univeks SB (Unitika Ltd.), and has a porosity of 50 Vol %. At the bottom inside the bag Bi, an insulation coated, plate-shape heating element 7, sandwiched between the bag Bi and the package Pi, is attached to the package Pi via a thin plate (which may be a thin metallic plate) 16 as occasion demands.

Used as a substance constituting the beads 15 is a reversible swelling and contractive substance, which, with a a certain temperature (a transition temperature determined depending upon individual substances) defined as the boundary, absorbs a swelling solution and then swells at a temperature below (or above) the transition temperature, and discharges the swelling solution and then contracts at a temperature above (or below) the transition temperature. The heating element 7 is to heat the beads 15 to above the transition temperature.

In case that the beads made of a substance, which swells at a temperature below the transition temperature and contracts at a temperature above the transition temperature, are used, the expanding and shrinking mechanism of the package Pi is described next. FIG. 5 and FIG. 6 show a state in which as a result of current flowing to the heating element, the beads 15 have been heated up to a temperature over the transition temperature. Out of this state, when current flowing to the heating element 7 of the neighboring $Pi_{-1}$ and $Pi_{+1}$ is initiated with discontinuation of current flowing to the heating element 7 attached to the package Pi, the beads 15 are cooled down to below the transition temperature due to natural cooling, causing a swelling solution W to be introduced from the heated neighboring packages into the package Pi as shown by arrows in FIG. 5 via the pipes 6 and 5, and the porous plates 13 and 14. Then, the beads 15 absorb the above introduced swelling solution W and then swell, thus resulting in the expansion of the package Pi. Since the bag Bi containing the packages Pi is, as described above, so contrived as to be expandable and shrinkable only in upward and downward directions, the above mentioned expansion of the package Pi allows the bag Bi to expand upward. When current flowing to the heating element 7 is reopened coupled with the discontinuation of current flowing to the neighboring packages $Pi_{-1}$ and Pi+1, the beads 15 are heated to above the transition temperature and discharge the swelling solution W. The discharged swelling solution W moves in the opposite directions to the above mentioned ones and flows out of the package Pi. It is then absorbed by the packages $Pi_{-1}$ and $Pi_{+1}$, and the package Pi and the bag Bi shrink to their original dimensions (those of FIG. 5). It is also acceptable to provide a filter to the entrance of the package.

Figure 7A:
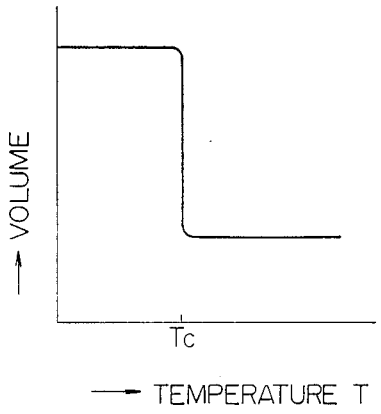
FIG. 7A and FIG. 7B are the graphic representations of the relationship between the temperature and volume of a reversible swelling substance.
Figure 7B:
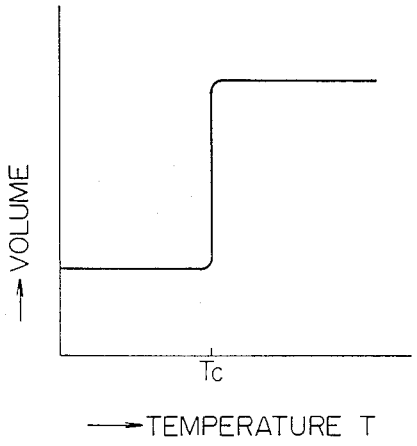

FIG. 7A is a graph showing the volume change with temperature T for a substance which swells at a temperature below the transition temperature and contracts at a termperature above the transition temperature. FIG. 7B is a graph showing the volume change with temperature T for a substance which, in contrast with the above mentioned case, swells at a temperature above the transition temperature and contracts at a temperature below the transition temperature. For prevention of decubitus, a reversible swelling substance, which exhibits a characteristic as that in FIG. 7A, is preferable to avoid burning the sick person. This is because it is safer that the temperature inside the packages remains low under a swelling state of the substance, in which the packages should expand and press the regions of the sick person's body.

The reversible swelling substance is so prepared that the relation of the initial degree of swelling $\beta$ in the initial state with the degree of swelling $\alpha$ in the state of equilibrium swelling is $1<\beta<\alpha$. The state of equibrium swelling means a swelling state in which the beads with a specific composition are maintained at a specific temperature $T<Tc$ (in case of FIG. 7A) for a sufficient time when they are soaked in a sufficient quantity of the swelling solution around them. Here, $\alpha$ is $V_m/V_o$, and $\beta$ is $V/V_o$, wherein, $V_o$ is a volume during contraction of the above mentioned substance, $V_m$ is a volume during equilibrium swelling of the substance, and V is a volume during initial swelling in the initial state. $V_m$ is a volume upon swelling when $T<Tc$ (FIG. 7A) or $T>Tc$ (FIG. 7A) and when there is a sufficient quantity of the swelling solution. If $\beta=\alpha$, the swelling solution does not move between the packages with the rise or fall of the temperature Tc, and if $\beta=1$, there is no movable swelling solution, so that any of these cases is inconvenient. The relationship between $\beta$ and $\alpha$ may be properly determined based on the relation of $1<\beta<\alpha$ and in what heating and cooling cycle each package should be used.

Although the reversible swelling substance is, as mentioned above, highly responsive and convenient as well in the form of spherical beads, it may be in the shape of crushed material or sponge. In case of beads, the finer, the more preferable they are, because the above mentioned responsiveness is inversely proportional to the square of their size. The responsiveness of the beads may be properly determined since it further depends upon what spaces of the porous plates 14 are provided.

Assume that the diameter of the bead is about 1 mm, the responsiveness of the volume change of each package in the mats for prevention of decubitus of FIG. 1 to FIG. 6 is in the unit of minute, for example, ten and several minutes. This responsiveness can be controlled by the volume and heat conduction of the reversible swelling and contractive substance as well as the degree of resistance upon movement of the substance, other than the size of the above mentioned bead.

It is most convenient to use water as the swelling solution. Substances, which show a characteristic as that in FIG. 7A when water is used as the swelling solution, include those gels that are composed of water and a threedimensionally cross-linked copolymer, such as homopolymers of (meth)acrylamide and vinyl ether substances as specified below. In addition, the copolymers of (math)acrylamide also include those showing a characteristic as that in FIG. 7B.

The homopolymers of (meth)acrylamide include the polymers of the following derivatives: N-mono-substituted acrylamide derivatives whose substituent groups are ethyl, n-propyl, i-propyl, and cyclopropyl; N, N-di-substituted acrylamide derivatives whose substituent groups are ethylmethyl and diethyl; N-substituted methacrylamide derivatives whose substituent groups are cyclic N-acrylpyrrolidine, N-acrylpiperidine, n-propyl, i-propyl, and cyclopropyl. The copolymers of (meth)acrylamide include a copolymer of the above mentioned monomer or a monomer which provides such water-insoluble polymers as (meth)acrylamide derivatives or (meth)acrylester derivatives and a polymer which provides such water-soluble polymers as acrylamide, N-methylacrylamide, N, N-dimethyl acrylamide, methacrylamide, methylacrylamide, ethyl methacrylamide, acrylic acid, and methacrylic acid.

The percentage composition is properly determined depending upon the temperature which causes the targeted volume change and the size of the change.

In addition, methyl vinyl ether is mentioned as a vinyl ether substance.

Useable other than the above mentioned stubstances are the substances which the present applicant previously disclosed and which are set forth in the Japanese Patent Publication Open to Public Inspection No. 55180/1986, namely, those which are the polymers obtained by polymerizing monomers (containing principally N-substituted (meth)acrylamide derivatives) under the presence of crosslinked monomers and which contain no ionizable groups. Further, they may be the substances which contain ionizable groups.

The degree of crosslinking is properly determined depending upon the size of the change in the volume of the targeted gel.

As a method of crosslinking, in case of di- and trivinyl compounds, N, N'-methylene bis-acrylamide, ethylene glycol dimethacrylate, glycerin triacrylate, divinylbenzene, etc. are used in a range of amount from 0.1 to 10 mol %.

Moreover, the above method may be performed by selfcrosslinking during or following polymerization reaction or by radiation in $\gamma$ rays irradiation, etc.

As a method of polymerization, a mixture of monomers can be polymerized by diluting it with a solvent, for example, water, lower alcohol or hydrocarbon, or by using a polymerization initiator, for example, a radical generating agent without diluting it. When a polymer is obtained from a mixture of monomers, however, a solvent or polymerization initiator is not necessarily an important factor, and a means may be instead selected from the known polymerization means to be put into practice.

For the heating element 7, a PTC (positive temperature coefficient) heating element, whose electric resistance is increased by elevation of temperature, is advantageous for the purposes of reducing power consumption and ensuring safety. The materials of the above heating element include barium titanate ($BaTiO_3$), a mixture of carbon black with a polymer material, etc. The dimensions of the heating element 7 are those of a plate-shape object in correspondence with the dimensions of the package, and are determined by the number of packages within a range of 90 cm in length and several to 20 cm in width. In this example, the dimension of width is set at 17 cm. It is appropriate that the above heating element operates at a low voltage, with the output to be set at a wattage which enables the temperature of the reversible swelling and contractive substance to rise above the transition temperature (the wattage may be also determined based on the frequency of ON-OFF changeover), and is provided with insulation coverage to be replaceable for repair.

Figure 8:
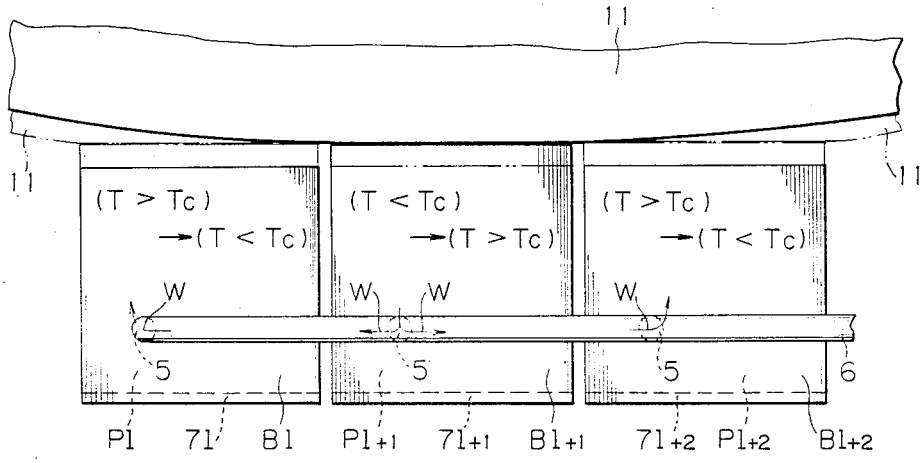
FIG. 8 is a front view of a main portion to explain the mechanism of the expansion and shrinkage of bags.

Next, a situation in which the distribution of pressure given to a sick person is changed while supporting him with each package will be described with reference to FIG. 8. FIG. 8 illustrates only the portions required for the expansion and shrinkage of packages and bags and part of the body of the sick person for the purpose of facilitating understanding.

FIG. 8 illustrates the following state (that of shrinking) by solid lines: the temperature T of the package $P1_{+1}$ in the bag $B1_{+1}$ is $T<Tc$; and the temperature T of the packages P1, $Pl_{+2}$ in the bags B1, $B1_{+2}$ is $T>Tc$. In this state, with current flowing to the heating elements 71 and $71_{+2}$, the packages P1 and $P1_{+2}$ have shrinked inside, and with current flowing to the heating element $71_{+1}$ stopped, the package $P1_{+1}$ has swollen inside. Under this state, as a consequence, the bag $B1_{+1}$ is pressing the sick person 11. Since decubitus occurs when this state lasts long, current is allowed to flow to the heating element $71_{+1}$, coupled with the discontinuation of current flowing to the heating elements 71 and $71_{+2}$, when a proper time has elapsed. Then, the package $P1_{+1}$ undergoes a change from $T<Tc$ to $T>Tc$, and the packages P1 and $P1_{+2}$ also are subjected to a change from $T>Tc$ to $T<Tc$. Therefore, with the package $P1_{+1}$ shrinking inside, the water W moves to the packages P1 and $P1_{+2}$ as shown by arrows due to a load received from the sick person, and the packages P1 and $P1_{+2}$ swell inside. As a result, each bag shrinks ($B1_{+1}$) or swells (P1 and $B1_{+2}$) as shown from solid lines to virtual lines or vice versa, so that the sick person 11 is pressed not by the bag $B1_{+1}$, but by the bags B1 and $B1_{+2}$. Such a change in the volume of each package causes the distribution of pressure received by the sick person to be changed only with current flowing, or discontinuation of current flowing, to each heating element in accordance with a prescribed program, thus leading to the prevention of decubitus.

The height of the branch pipes 5 and the communicating pipe 6 can be varied, for example, it can be located near the bottoms of the packages Pi.

Figure 9:
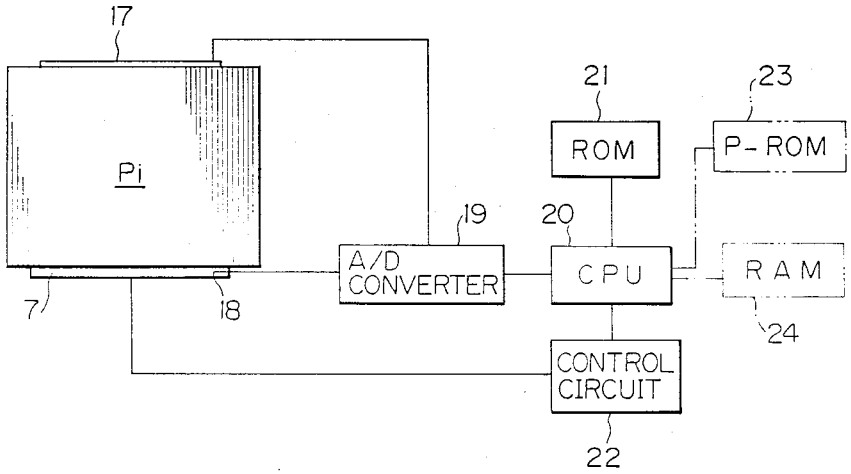
FIG. 9 is a block diagram showing an outline of the control of the expansion and shrinkage of a package.

The change in the volume of each package Pi is made in accordance with a prescribed program as illustrated in FIG. 9. The upper surface of the package Pi is fitted with a pressure sensor, for example, a load cell 17 (which may be a paper gauge instead) as occasion demands, and the heating element 7 is fitted with a temperature sensor, for example, a thermocouple 18 as occasion demands. The pressure or temperature detected by the pressure sensor 17 or the temperature sensor 18 is converted to a digital signal at an A/D converter, and the signal is transmitted to a CPU (central processing unit) 20. The CPU 20 compares and operates the data from an ROM (read-only memory) 21 and the signal from the A/D converter 19 and then allows a control circuit 22 to operate, thus ensuring current flowing or discontinuation of current flowing to the heating element 7 in a selective manner.

It is possible to properly change the program by using a P-ROM (programmable read-only memory) 23 or an RAM (random access memory) 24. This control can be performed at both hospital and home subject to the program of the user. In other cases, sequential control with time can be carried out following the conditions that are experimentally obtained in advance.

In accordance with this example, as explained above, the distribution of pressure received by the sick person can be changed by current flowing or discontinuation of current flowing to the heating element, and the development of decubitus can be prevented; in addition, there is no factor for generation of noise because any special power source for other than current flowing to the heater does not need to be used; and, moreover, the apparatus is of simple structure and durable, with low manufacturing cost being obtainable.

While the above mentioned example is the one with reference to the bedclothes for prevention of decubitus, a similar effect can be ensured by applying the present invention to a wheelchair.

In the next, a concrete example will be explained.

A temperature sensitive gel showing the transition of FIG. 7A was synthesized. This temperature sensitive gel is isopropyl acrylamide gel as shown in the previously mentioned Japanese Patent Publication Open to Public Inspection No. 55180/1986.

Figure 10:
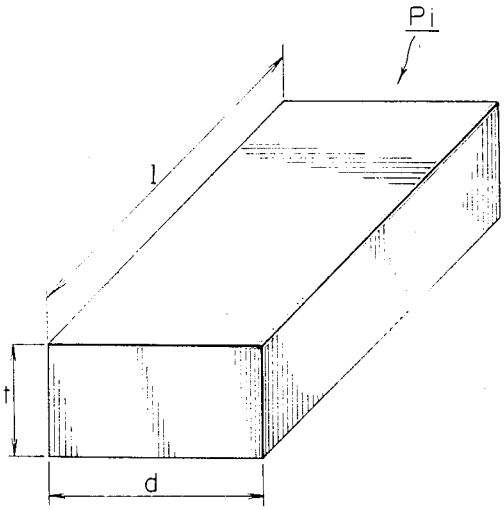
FIG. 10 is a schematic perspective view showing the dimensions of a package.

The above mentioned temperature sensitive gel was packed together with a porous plate into the package Pi ($i=1$ to 12) that is a thin rubber as shown in FIG. 10, airtight square tube which has a thickness t of 7.5 cm, a width d of 17 cm, and a length l of 90 cm and one end of which is closed.

Figure 11:
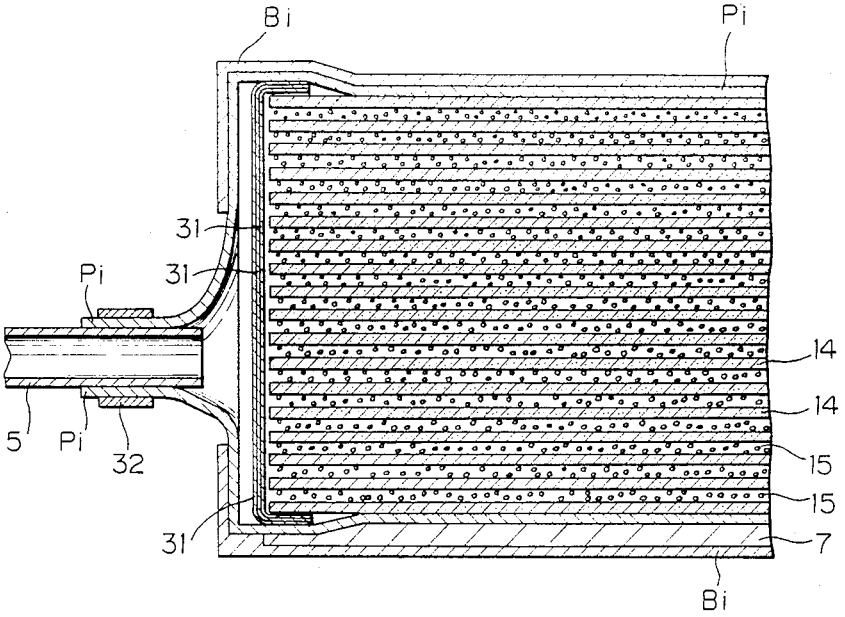
FIG. 11 is a sectional view of a package contained in a bag.

FIG. 11 is a sectional view of the initial state of the package Pi which is contained in the bag Bi. 18 plates with a thickness of 2 mm were superposed on one after another to be used as the porous plates 14, and the temperature sensitive beads 15 were packed into the spaces between the respective porous plates 14 in a state that they were thinly spread in-between. With gauze 31 applied to the opened entrance of each package, a filter was obtained that prevents the beads 15 of the temperature sensitive gel from flowing outside the package in line with the incoming and outgoing of the swelling solution. The branch pipe 5 was obtained by fitting a vinyl tube (having 10 mm in inside diameter and 10 cm in length) to the opened entrance of the package and then fastening the tube with a fixing member 32 to prevent water leakage. After the swelling solution (water) was poured in the package through said branch pipe so that the degree of swelling $\beta$ in the initial stage of gel$=0.5\alpha$ ($\alpha$: the degree of equilibrium swelling), the branch pipe 5 was connected with the communicating pipe 6 (see FIG. 4). After the remaining packages were likewise connected with the communicating pipe, the portions of the branch pipes and the communicating pipe were filled with the swelling solution to prevent air from ramaining, and were then sealed.

Figures 12A, 12B, 12C, 12D, 12E:
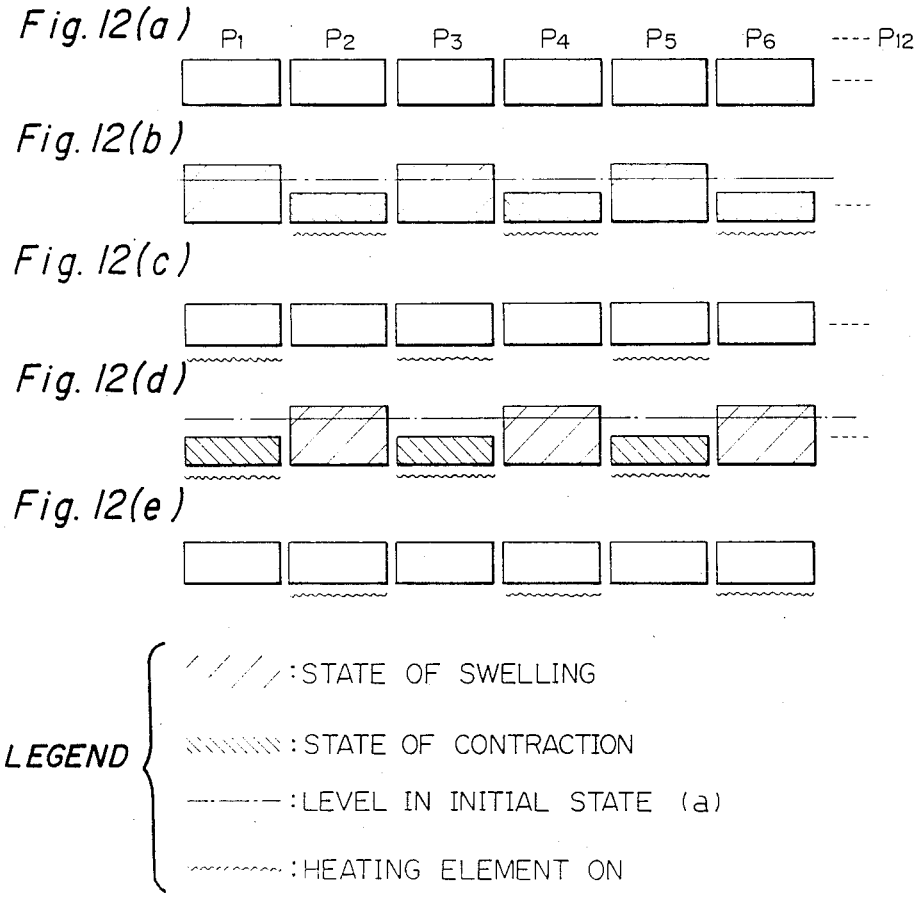
FIGS. 12 (*a*), (*b*), (*c*), (*d*) and (*e*) are schematic front views showing the motion of each package during its use.

FIGS. 12 (*a*) to (*e*) are schematic views showing a state in which each package repeats expansion and shrinkage when used. In this drawing, each portion constituting the package and the portions connecting these packages are omitted.

FIG. 12 (*a*) shows the initial state, in which each of the packages $P_1$ to $P_{12}$ has the same thickness (7.5 cm). From the point where the gel temperature exceeds the transition point of 35° C. by allowing the respective heating elements of even-numbered packages $P_2, P_4, \ldots, P_{12}$ to heat, the above packages $P_2, P_4, \ldots, P_{12}$ begin to shrink, and the swelling solution ejected from these packages $P_2, P_4, \ldots, P_{12}$ enters odd-numbered packages $P_1, P_3, \ldots, P_{11}$ whose temperature is maintained below the transition temperature. After sufficient time elapses, the even-numbered packages $P_2, P_4, \ldots, P_{12}$ shrink, while the odd-numbered packages $P_1, P_3, \ldots, P_{11}$ expand, thus going into the state of FIG. 12 (*b*). At this point, the thickness of the even-numbered packages $P_2, P_4, \ldots, P_{12}$ is 5 cm, whereas the thickness of the odd-numbered packages $P_1, P_3, \ldots, P_{11}$ accounts for 10 cm.

Next, current flowing to the heating elements of the even-numbered packages $P_2, P_4, \ldots, P_{12}$ is discontinued, while current is allowed to flow to the odd-numbered packages $P_1, P_3, \ldots, P_{11}$. The odd-numbered packages $P_1, P_3, \ldots, P_{11}$ increase in temperature and begin to shrink from the point where their temperature exceeds the transition temperature. The even-numbered packages $P_2, P_4, \ldots, P_{12}$ are cooled and expand with supply of the swelling solution from the packages $P_1, P_3, \ldots, P_{11}$, thus going into a state as shown in FIG. 12 (*d*) via a state as shown in FIG. 12 (*c*). In this state, the thickness of the even-numbered packages $P_2, P_4, \ldots, P_{12}$ is 7.5 cm, and the thickness of the odd-numbered packages $P_1, P_3, \ldots, P_{11}$ is 5 cm.

Then, upon discontinuation of current flowing to the heating elements of the odd-numbered packages $P_1, P_3, \ldots, P_{11}$ as well as upon start of current flowing to the respective heating elements of the even-numbered packages $P_2, P_4, \ldots, P_{12}$, the packages return to the state of FIG. 12 (*b*) via that of the same drawing (e).

When the above mentioned motions are repeated, the packages continue to change in turn their heights as shown in FIGS. 12 (*b*), (*c*), (*d*), (*e*), (*b*), (*c*), . . .

In this example, as described above, a state can be created that a load supporting portion and a load non-supporting portion can alternately change at intervals of 17 cm in terms of place as well as time along the direction of the height of a lying patient, and the same regions of his body are not conitnously pressed by the bedclothes at all times, so that the occurrence of decubitus can be prevented.

Figure 13:
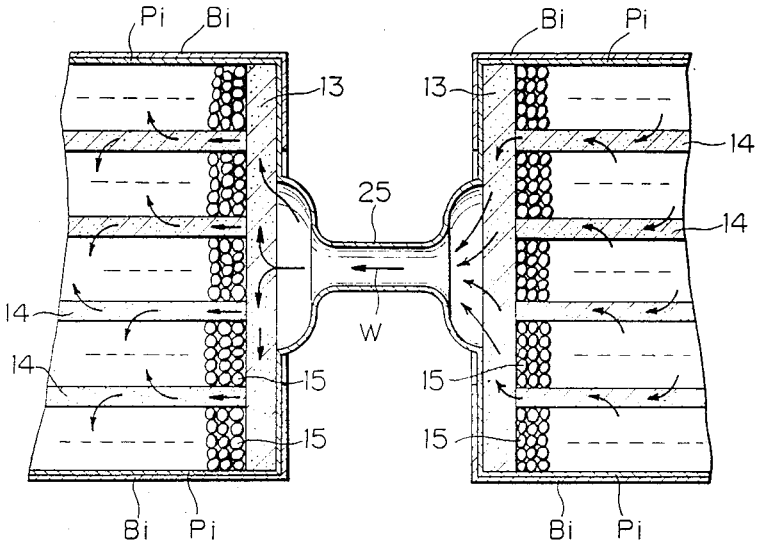
FIG. 13 is a partial sectional view showing a method of connecting packages in accordance with another example.
Figure 14:
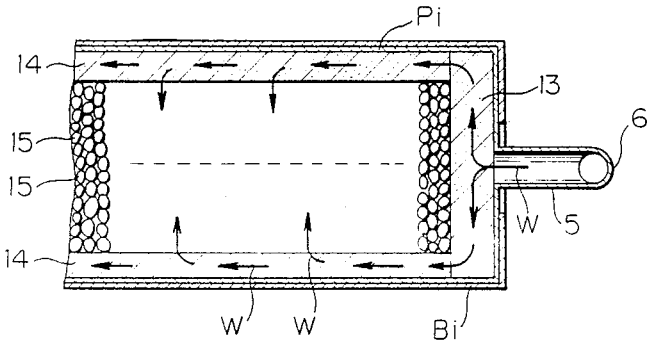
FIG. 14 is a sectional view of the inside of a package in accordance with still another example.

The connection or structure of the packages can be configured as in the structure of FIG. 13 or FIG. 14, other than FIG. 5.

FIG. 13 shows an example in which neighboring packages Pi are allowed to communicate with each other with the pipe 25. Therefore, a pipe equivalent to the pipe 6 in FIG. 4 is not used. The other aspects are the same as those in the structure of FIG. 5. Water W is supplied to the beads 15 as shown by arrows (same in FIG. 11).

In the package of FIG. 14, the horizontal porous plates 14 in the package Pi are used only by two plates, upper and lower.

In any of the above examples, the bags are to be plain fabrics made of polyester thread and spandex thread. For other types, the bag may be formed in the type of bellows so as to exapnd and shrink only in a fixed direction in the form of an accordion. The expanding-shrinking direction may also be set as one other than an upward or downward direction.

[EXAMPLE 2]

This example and the examples 3 and 4, which will be described later, are those in which the present invention was applied to a heavy object supporting apparatus which enables the ascent and descent of heavy objects, that is, a jack.

Figure 15:
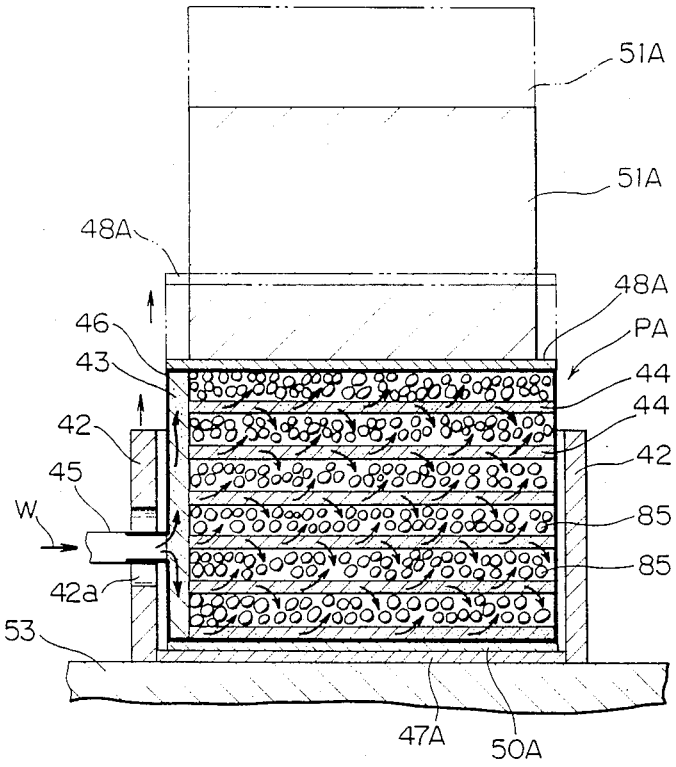
FIG. 15 is a sectional view of a level-variable supporting apparatus.

FIG. 15 is a sectional view of a jack.

A package PA is composed of a surrounding rubber wall 46, and is placed on a floor 53, with a heating element 47A attached to its bottom surface via a protective metallic thin plate 5. The heating element 47A is the same PTC heating element as the heating element 7 of the above mentioned example 1 (also same in case of the heating elements in the examples 3 and 4 which will be described later). One end portion inside the package PA contains a first porous plate 43 in a longitudinal direction, and a plurality of second porous plates 44 in a horizontal direction and in contact with the first porous plate 43, and beads 85 made of a reversible swelling and contractive substance are packed between the respective second porous plates 44. As the porous plate 43, soft polyurethane foam, etc. having a porosity (open cell ratio) of, for example, 30 vol % or more can be preferably used so as to be able to follow the movement of the porous plates 44 in an upward or downward direction. The porous plates 44 are made of, for example, Univeks SB in the tradename (Unitika Ltd.), and has a porosity of 50 vol %. The package PA is surrounded by restricting plates 42 and is designed to expand or shrink in an upward or downward direction. A pipe 45 communicating with the package PA is inserted into an upwardly and downwardly long and narrow through hole 42*a* which is provided to the restricting plates 42, and is connected with the first porous plate 43. The pipe 45 is communicating with a water tank (not illustrated). The entrance of the package may be provided with a filter. The spaces between the second porous plates are packed with beads 85.

The plane dimensions of the package PA in FIG. 15 are set at 90 cm×17 cm in quadrilateral and 7.5 cm in height. A heating element 47A is a flat shape heating element with a voltage of 100 V and an output of 150 W. For the reversible swelling and contractive substance making up the beads 85, isopropyl acrylamide gel as presented in the Japanese Patent Publication for Public Inspection No. 55180/1986 was used as a temperature sensitive gel showing the transition of FIG. 7B (in case of the examples 3 and 4 which will be described later). The reason why the substance showing the transition of FIG. 7B was used as the one which made up the beads 85 is that it is more favorable from the viewpoint of power consumption to allow the beads 85 to swell and in turn cause the package PA to expand upwardly when a heavy object 51A (which is placed on the package PA via a supporting plate 48A) is allowed to ascend.

The transition temperature Tc of this gel (the bead) was 35° C., and its degree of equilibium swelling $\alpha$ was 100. The total quantity of water was adjusted so that the initial degree of swelling $\beta=0.5\alpha$.

When the beads 85 are heated to above the transition temperature Tc by allowing current to flow to the heating element 47A, the beads 85 absorb the water W and swell, and the package PA expands upwardly and allows the heavy object 51A on the supporting plate 48A to ascend as shown by virtual lines. At this occasion, the water W is supplied from the first porous plate 43 to the beads 85 via the second porous plates 44. When current flowing to the heating element 47A is discontinued, the beads 85 are cooled to below the transition temperature Tc by natural cooling and then shrinks, discharging the water W in an opposite way to the arrows. Thus, the package PA shrinks downwardly, and the heavy object 51A in turn descends.

As the heavy object 51A in this example, the one having a weight of 1.5 kg could ascend and descend many times over. Moreover, this ascending and descending was quiet without noise and vibration, accompanying no contamination by water leakage and the like. As a consequence, the apparatus in accordance with this example is extremely suitable for lifting or lowering those articles, for example, electronic components, that need to be gently handled in a clean environment.

[EXAMPLE 3]

Figure 16:
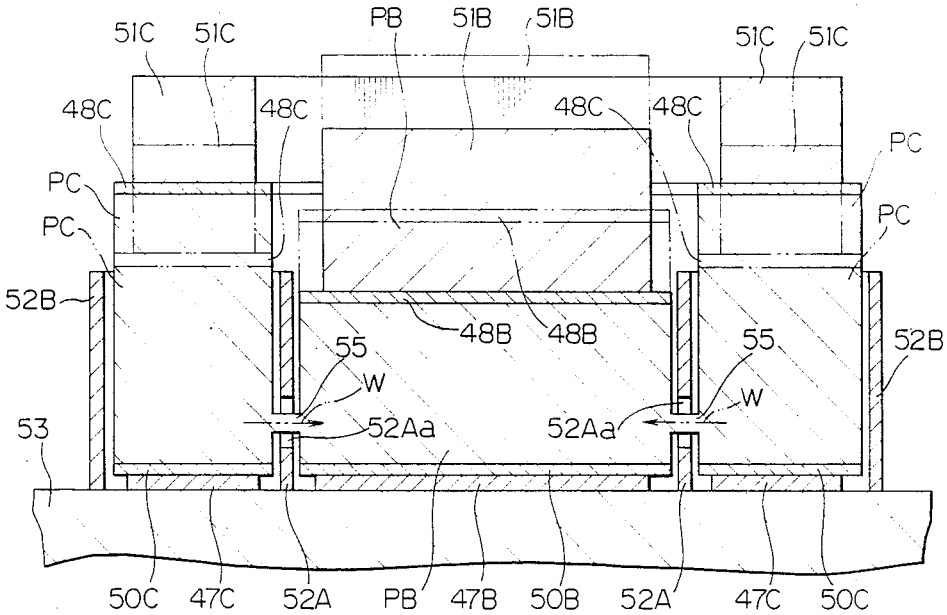
FIG. 16 and FIG. 17 are the sectional views of level-variable apparatuses in accordance with other examples, respectively.

FIG. 16 is a sectional view showing a state in which with an annular package PC placed around a columnar package PB on a floor 53, the package PB was allowed to support a heavy object 51B above it, while the package PC was allowed to support the heavy object 51C above it. Although the internal structures of the packages PB and PC are omitted from the illustration, these structures are the same as those of FIG. 15. It is so contrived that the packages PB and PC are allowed by a pipe 55 to communicate with each other and are surrounded by restricting plates 52A and 52B to expand or shrink only in an upward or downward direction. In the illustration, 52A is a through hole through which pipes 55 penetrate.

In FIG. 16, solid lines are showing a state in which the package PB has shrunk, and the package PC has expanded, as a result of the discontinuation of current flowing to a heating element 47B and the initiation of current flowing to a heating element 47C. Out of this state, when the inside of the package PB is heated via a metallic plate 50B with discontinutation of current flowing to the heating element 47C beneath a metallic plate 50C as well as the initiation of current flowing to the heating element 47B, the water W moves, as shown by virtual lines, from the package PC to the package PB in the same manner as in the example of FIG. 15. Thus, with the expansion of the package PB and the shrinkage of the package PC, the heavy object 51B on a supporting plate 48B ascends, and a heavy object 51C on a supporting plate 48C descends, as shown by virtual lines. As a matter of course, the opposite motions to these ones can also be taken.

[EXAMPLE 4]

Figure 17:
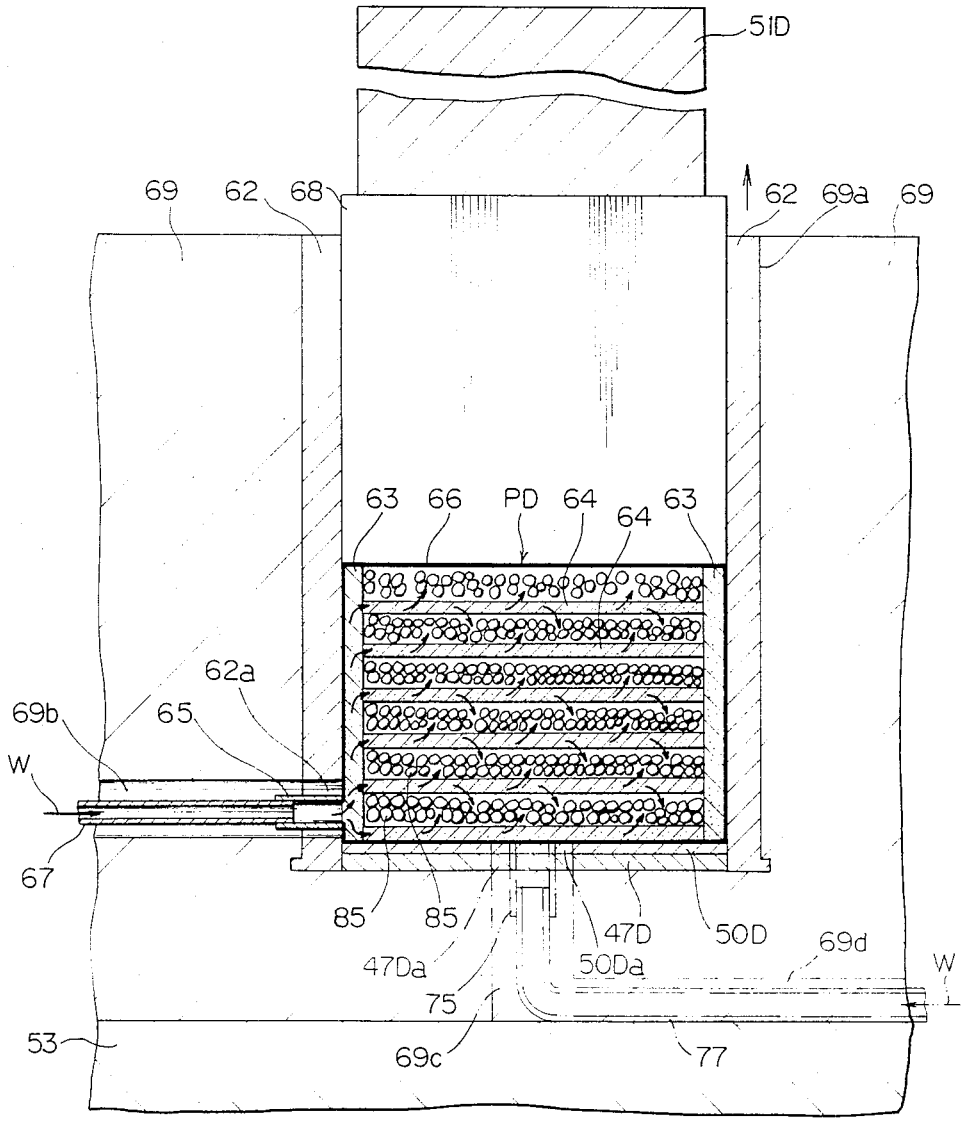

FIG. 17 shows an example of the apparatus which supports a heavy object on a package via a ram and thus allows said heavy object to move upward or downward.

An apparatus body 69 is installed on floor 53. The body has a blind hole **69*a* bored, in which a cylinder liner 62 is housed. Then, a cylindrcal package PD and a ram 68 are in turn inserted in the cylinder liner. The body 69 and the cylinder liner 62 are provided with through holes 69*b* and 62*a*, respectively, and a pipe 67, which communicates with a water tank (not shown in the illustration), is allowed to penetrate through the through hole 69*b*. The package PD is composed of rubber surrounding wall 66, and a pipe 65 is connected with the side wall of the package PD. The pipe 65 is further connected with the pipe 67. Cylindrical first porous plates 63 are housed into the package PD in contact with the surrounding wall 66. Plural sheets of second porous plates 64 are horizontally inserted inside the first porous plates 63, and beads 85 are packed above each of the second porous plates 64**.

FIG. 17 is illustrating a state in which the beads 85 have shrunk. When the beads 85 are heated to above the transition temperature Tc via a metallic plate 50D by allowing current to flow to a heating element 47D underneath the package PD, water W is introduced into the package PD as shown by arrows, causing the beads 85 to swell, and the package PD is restricted by the cylinder liner 62 to swell only upward, causing the ram 68 to ascend in the cylinder liner 62. Thus, a heavy object 51D placed on the ram 68 ascends. When current flowing to the heating element 47D is discontinued, the beads 85 are cooled to below the transition temperature Tc and shrink. With the discharge of the water W in the opposite direction to the arrows, the package PD and the ram 68 return to their original states, and the heavy object 51D in turn descends to be back to the state of FIG. 17.

Feeding and discharging of the water W may be contrived to be performed on the bottom surface of the package PD. In this case, the bottom of the body 69 is, as shown by virtual lines in FIG. 17, provided with a through hole **69*c* which is opening to the blind hole 69*a*, and further with a groove 69*d* which is connected with the through hole 69*c*. The metallic plate 50D and the heating element 47D are provided with a through holes 50D*a* and 47D*a*, respectively. Inside the through hole 69*c*, a pipe 75 is connected with the bottom of the package PD. A pipe 77, connected with the pipe 75, is contained in the groove 69*d*, its terminal side being curved and connected with the pipe 75 in the through hole 69*c*. The rest portions are not different from those in the above mentioned example shown by solid lines in FIG. 17**.

Both of the apparatuses of FIG. 16 and FIG. 17, as in case of the apparatus of FIG. 15, quietly ascended or descended without generating any noise and vibration when going up or down, with no finding of contamination by water leakage, etc.

As described above, the apparatuses of FIG. 15, FIG. 16 and FIG. 17 can cause a heavy object to quietly ascend and descend only through current flowing to the heating element and discontinuation of the current flowing. They possess durability and, moreover, cause no oil leakage unlike in case of utilization of oil hydraulics, thus leading to no contamination. Therefore, they are highly superior as jacks.

In the above described Examples 2, 3 and 4, the package is composed of rubber surrounding walls in any of them. For the other aspects, a liquidtight thin plate may be formed to be bellows-shape, and be allowed to expand and shrink only in fixed directions. The exanding and shrinking directions may be ones other than the upward and downward directions.

It will be evident that various modifications can be made to the described embodiments without departing from the scope of the present invention.

What is claimed is:

1. A level-variable supporting apparatus comprising:

at least one liquidtight container which is expandable and shrinkable in a prescribed direction;

a reversible swelling and contractive substance contained within said at least one container, said substance having a property such that it absorbs a swelling solution in a first range of temperatures so as to cause said substance to swell and discharges said swelling solution in a second range of temperatures so as to cause said substance to contract;

a liquid guide means connecting said at least one container to a source of swelling solution such that said solution may be supplied into and discharged from said container; and a controllable heating means in heating relationship with said substance in said at least one container so as to control the temperature of said substance to vary between said first range and said second range to thereby control absorption and discharge of said swelling solution and cause said substance to controllably swell and contract, causing said at least one container to expand and shrink in said prescribed direction so as to change a supporting position of an object thereon.

2. A supporting apparatus as recited in claim 1 forming a mat for prevention of decubitus, comprising:

a plurality of first expandable liquidtight containers containing said reversible swelling and contractive substance;

a plurality of second containers which contain said first containers, respectively, and which expand and shrink only in a prescribed direction; and a controllable heating means for heating said substance in each said first containers to control the temperature of said substance in each container so as to change a supporting position of an object supported by said containers.

3. A supporting apparatus forming a mat as recited in claim 2, wherein said plurality of liquidtight containers are arranged alternately in a first group and a second group, and wherein controlling means is provided for controlling said heating means so that said first and second groups are heated alternately for alternate time periods, thereby causing said first and second groups to alternately expand and shrink such that said object is alternately supported by said first group and said second group of containers.

4. A supporting apparatus as in claim 2, wherein the directions of the expansion and shrinkage of the containers are in upward and downward directions.

5. A supporting apparatus as in claim 4, wherein the reversible swelling and contractive substance is a reversible swelling and contractive substance which swells at a temperature above a transition temperature and contracts at a temperature below the transition temperature.

6. A supporting apparatus as in claim 4, wherein a liquid guiding means is provided to a side wall of each container.

7. A supporting apparatus as in claim 6, wherein an annular container is placed around a columnar container, said columnar container and said annular container communicate with each other by the liquid guiding means, and a first supported object supported by said columnar container and a second supported object supported by said annular container can change relative supporting positions in opposite directions to each other.

8. A supporting apparatus as in claim 2, wherein the reversible swelling and contractive substance is a reversible swelling and contractive substance which swells below the transition temperature and contracts above the transition temperature.

9. A supporting apparatus as in claim 8, wherein the reversible swelling and contractive substance is a gel which is composed of water and three-dimensionally cross-linked polymer.

10. A supporting apparatus as in claim 9, wherein the reversible swelling and contractive substance is composed of beads.

11. A supporting apparatus as in claim 2, wherein the reversible swelling and contractive substance has a relationship of $1<\beta<\alpha$, wherein, $\alpha$ is the degree of swelling in a state of equilibrium swelling of the reversible swelling and contractive substance, and $\beta$ is likewise a degree of swelling in the initial state.

12. A supporting apparatus as in claim 2, wherein the reversible swelling and contractive substance is sandwiched between porous plates for distribution of the swelling solution contained in the first containers.

13. A supporting apparatus as in claim 2, wherein said plurality of first containers are connected with each other by pipes so that the swelling solution can move between said first containers.

14. A supporting apparatus as in claim 2, wherein the material of the first containers has weatherability and heat durability.

15. A supporting apparatus as in claim 14, wherein the first containers are square tubes made of thin rubber.

16. A supporting apparatus as in claim 2, wherein the second containers are made of plain fabrics of warp and woof and which is made expandable and shrinkable only in upward and downward directions.

17. A supporting apparatus as in claim 2, wherein each controllable heating means is a plate-shape electric heating element.

18. A supporting apparatus as in claim 17, wherein each heating means is a PTC (positive temperature coefficient) heating element.

19. A supporting apparatus as in claim 17, wherein current flow to each heating means is selectively performed or discontinued subject to a prescribed program, leading to a control of the change in the volume of each of the first containers.

20. A supporting apparatus as in claim 1, wherein said at least one container is housed in a cylinder, and said object is supported above said container via a ram in said cylinder.

21. A supporting apparatus as in claim 1, wherein said at least one container is housed in a cylinder, said object is supported on said container via a ram in said cylinder, and a liquid guiding portion is provided on a bottom surface of said container.

* * * * *